US005182172A

United States Patent [19]

Tucker

[11] Patent Number: 5,182,172

[45] Date of Patent: Jan. 26, 1993

[54] POST-PLATING PASSIVATION TREATMENT

[75] Inventor: John F. Tucker, Rochester, N.Y.

[73] Assignee: Bausch & Lomb Incorporated, Rochester, N.Y.

[21] Appl. No.: 686,736

[22] Filed: Apr. 18, 1991

[51] Int. Cl.[5] ..... C23C 28/00

[52] U.S. Cl. ..... 428/632; 205/149; 205/176; 205/197; 351/41; 428/935

[58] Field of Search ..... 204/35.1, 38.1, 40, 204/47.5; 205/197, 176, 149; 428/632, 935; 351/41

[56] References Cited

U.S. PATENT DOCUMENTS 3,772,165 11/1973 Yamagishi et al. ..... 204/28
4,071,417 1/1978 Koontz et al. ..... 204/38.4
4,842,961 6/1989 Basile et al. ..... 428/672

FOREIGN PATENT DOCUMENTS 56-89716 7/1981 Japan .

OTHER PUBLICATIONS

Fred W. Eppensteiner et al., Chromate Conversion Coatings, *Metal Finishing*, Sep., 1975, pp. 29-34.

*Primary Examiner*—John Niebling
*Assistant Examiner*—William T. Leader
*Attorney, Agent, or Firm*—Salvatore P. Pace; David M. Krasnow

[57] ABSTRACT

An improved method for inhibiting corrosion of precious metal plated objects is provided wherein a thin dichromate film coats the precious metal outer surface and fills the precious metal outer surface pores using either immersion or electrolytic methods employing passivation plating techniques. The method is useful in the manufacture of eyewear frames 7 Claims, 1 Drawing Sheet

POST-PLATING PASSIVATION TREATMENT

BACKGROUND OF THE INVENTION

The many attributes of gold as a functional material have long been recognized. Superior conductivity, relative corrosion resistance, ease of handling, and general elemental stability are but a few beneficial characteristics of this versatile element. However, gold's recent price per ounce is so expensive that most manufacturers of consumer products other than fine specialty electronics (which may necessitate pure gold contacts and other gold circuitry) must settle for gold plating as a means to keep the product's eventual unit price within acceptable market boundaries.

The electroplating industry has observed the realization that gold-plating is often an acceptable substitute for the use of pure gold in certain situations. Relatively pure gold (up to 99.9999% pure) is readily available and can easily be fashioned into highly soluble gold salts such as, for example potassium gold cyanide (PGC). These convenient salts can then be used to prepare plating baths by putting the PGC into solution under specified conditions. Gold plating traditionally gives a strong, hard deposit onto the plated substrate of choice which can vary widely. In this way the superior elemental properties of gold can be imparted upon base metals, alloys, other electroplate layers, or previously plated or otherwise treated non-metallic substrates.

However, certain physical properties of gold, such as its relative porosity, translate into problems when gold is plated onto a substrate. For instance, gold's porosity can create interstices on the plated surface. These very small spaces can contribute to corrosion or actually accelerate corrosion through the galvanic coupling of the gold layer with the underlying base metal plate layer or layers. This is apparently due to the fact that the base metal substrate and any accompanying underlying metal layers may be exposed to corrosive elements via the pores in the plated gold outer surface.

In the field of fashion eyewear, due to the significant realized cost savings, gold plate has often been used to plate the metal eyewear frames. Further, in the field of high-performance eyewear, such gold plating often becomes functional in nature. For example, if the eyewear is expected to be used by military personnel, the gold plating must pass certain rigorous corrosion tests, since the eyewear can be expected to be used in a variety of different climates and be exposed to various corrosive conditions (e.g. salt water, sea spray, fog, excessive humidity, perspiration, airborne pollutants, etc.). Similarly, various professional sporting activities can expose gold-plated eyewear to the same abovelisted corrosive conditions.

Conventional gold electroplating has not been found to be entirely satisfactory. For example, it has been observed in the industry that even the most-expensive gold-plating processes, over time, begin to exhibit signs of corrosion. It is believed that the base metal substrate, or the primary or secondary metal plate layers underlying the final gold-plate layer begin to oxidize if exposed to corrosive conditions for sufficient time periods. It is further believed that gold's natural properties, which include a certain inevitable degree of porosity, at least partially contribute to this corrosion problem. Therefore, there has been an ongoing effort in the electroplating industry to overcome the corrosion problem resulting from gold's natural porosity.

At least three different approaches to overcoming the corrosion problems have been attempted: 1) reducing the porosity of the coating, 2) inhibiting the galvanic effects caused by the electropotential differences of different metals, and 3) sealing the pores in the electroplated layer. Reducing the porosity has been studied extensively in the past. Pulse plating of the gold and utilization of various wetting/grain refining agents in the gold plating bath affect the gold structure and are two factors contributing to a reduction in gold porosity. Often regular carbon bath treatments and good filtration practices in the series of electroplating baths or tanks, combined with a preventive maintenance program help to maintain good metal deposition levels and correspondingly low levels of surface porosity. A certain degree of porosity, however, continues to remain.

Pore closure, sealing, and other corrosion inhibition methods have been tried in the field with limited success. Possible mechanisms using organic precipitates having corrosion inhibitive effects are known in the art. Many of these compounds were typically soluble in organic solvents and were deemed not to provide long term corrosion protection. Other methods of pore sealing or pore blocking are based on the formation of insoluble compounds inside the pores. Such insoluble complexes and precipitates as will be apparent to those skilled in the field are also potential candidates for pore blocking. However, attempts at forming stable nickel complexes have been unsuccessful.

Passivation, as the term is used in connection with the present invention, is defined as the process of pore and surface layer sealing. Passivation is commonly practiced in the electroforming industry on a large scale. Mandrels are typically made from stainless steel or nickel. Stainless steel readily forms a passive surface layer due to the chromium or nickel alloy additions. Both nickel and chromium form stable passive films which most likely consist of adsorbed or chemically combined oxygen (oxides). These films are thin, typically measured in nanometers, and are relatively uniform. The advantage of these thin films in electroplating is that they are somewhat conductive, allowing for further electro-deposition. However, the passive surface layer at the interface allows for easy separation of the electroform from the mandrel after the deposition is complete.

The stainless steel that is often used in critical corrosion resistant applications is usually passivated in a nitric acid solution (20%) with or without the addition of a dichromate ion, $(Cr_2O_7)^{-2}$. Sodium or potassium salts of the dichromate are conventionally used in this operation with a thin film resulting which effectively provides corrosion resistance. The use of a plated dichromate ion layer is therefore not new in the electrochemical field. However, dichromates have traditionally been used only to mask, or create an intermediate pre-plate "masking" film layer on a base metal substrate when selective plating techniques are used.

For example, in the electronics industry, gold-plated circuitry is common. However, due to the high cost of gold, printed circuit boards and other parts are only selectively gold-plated. This intermediate dichromate process takes place before the final precious metal surface layer is plated. Dichromates are first applied to the base metal substrate, usually copper. The resulting dichromate layer left on the base metal substrate inhibits further plating by most metals, including gold. To then plate the desired final plate (e.g. gold) on the printed circuit, the dicromate layer must first be etched or otherwise selectively removed from the base metal. In these applications, the dichromate intermediate layer effectively acts as a plating inhibitor for the rest of the circuit board as the gold is then plated only in the etched pattern of the printed circuit. For examples, see U.S. Pat. Nos. 4,082,620 (Shurkiss) and 4,077,852 (Koontz, et al.).

Further, Sharfrin, et al. in Applied Surface Science, Vol. 4, (April, 1980) pp. 456–465, describe passivation of gold plating over copper base metal circuit boards in nuclear submarine navigational computers as a field repair measure.

Although the exact chemical mechanism remains unclear, it is believed that a corrosion problem from a galvanic mechanism involving the gold layer exists. For example, it is now believed that when a base metal substrate is plated with a primary nickel-containing electroplate, optionally followed with a secondary nickel-containing layer which is then plated with a final precious metal outer layer, galvanic coupling of the gold electroplate with the primary nickel or secondary nickel-containing layers occurs, resulting in an accelerated corrosion rate. The addition of a Pd/Ni layer over the primary nickel layer and under the final precious metal plate was tried in an attempt to decrease the electropotential difference betwen the primary nickel and the final outer precious metal plate layer. It was believed that the decreased electropotential would result in a reduced rate of corrosion. In fact, significant corrosion inhibition was observed. It is further believed that the Pd/Ni secondary plate layer therefore interrupts the galvanic couple between the gold and primary nickel layers. By the improved novel process of the present invention it was further discovered that the addition of the dichromate as a final post-treatment after the precious metal plate provided still greater corrosion resistance.

Therefore, in simple terms, passivation may be further defined as the formation of a film ( e.g. oxide) on a metal (anodic) surface, which will resist dissolution in a particular electrolyte thereby protecting the coated metal layers below. Such films may be penetrated by either electrolytic changes (e.g. chemical agents) to dissolve the film or by high electric potentials to induce transport of ions through the film to resume the anode dissolution reaction (corrosion).

SUMMARY OF THE INVENTION

The present invention relates to the reaction of dichromates with primary nickel electroplate layers, nickel-containing secondary plate layers or nickel-containing substrates through the pores of a final precious metal plate outer layer and with the nickel known to exist in the outer surface of the precious metal outer plating. The dichromate layer fills the pores of the precious metal plating layer at the outer surface and coats the outer surface with a thin dichromate film layer, which results in a greatly improved corrosion inhibition process.

In accordance with the foregoing observations, the invention further relates to an improved passivation process to seal the pores of a final gold plate, or other final outer precious metal plate which occurs over a primary nickel plate or secondary nickel-containing plate layer. The outer precious metal plate is coated in a post-plating procedure, forming a corrosion resistant barrier at the outermost plated layer pore surface through passivation techniques.

In addition, the improved process of the present invention can be viewed as providing a thin film coating of dichromate which reacts with the primary nickel plate layer or the secondary nickel-containing plate layer through the final precious metal outer plate in a post-plating procedure to improve upon known corrosion resistance levels.

The invention further contemplates the novel ability to post-plate precious metal plated objects, preferably gold-plated objects conveniently and inexpensively even months after the objects have been gold plated.

To fully realize the invention's unexpected degree of corrosion inhibition, one preferred embodiment of the invention contemplates the incorporation of a Pd/Ni plate layer as the secondary nickel-containing layer immediately under the final precious metal plate layer.

While the process of the present invention may be practiced to inhibit corrosion on any precious metal plated surface, the invention is thought to have a significant application generally in the field of eyewear. Regular spectacle frames and sun protective eyeglass frames worn in various corrosive environments have their lasting qualities significantly enhanced, as against corrosion, as a result of the present invention. It is thought that the invention is particularly useful with respect to eyeware designated for miltary applications or sporting activities; such eyeware is often subjected to corrosion due to marine or other salt exposure. Therefore, the invention is thought to be effective as an inexpensive and simple improved process to combat the effects of chloride-induced galvanic corrosion.

Further applications of the invention will become readily apparent to those skilled in the art upon examination of the following detailed description of the invention.

DETAILED DESCRIPTION OF THE INVENTION

Figure 1:
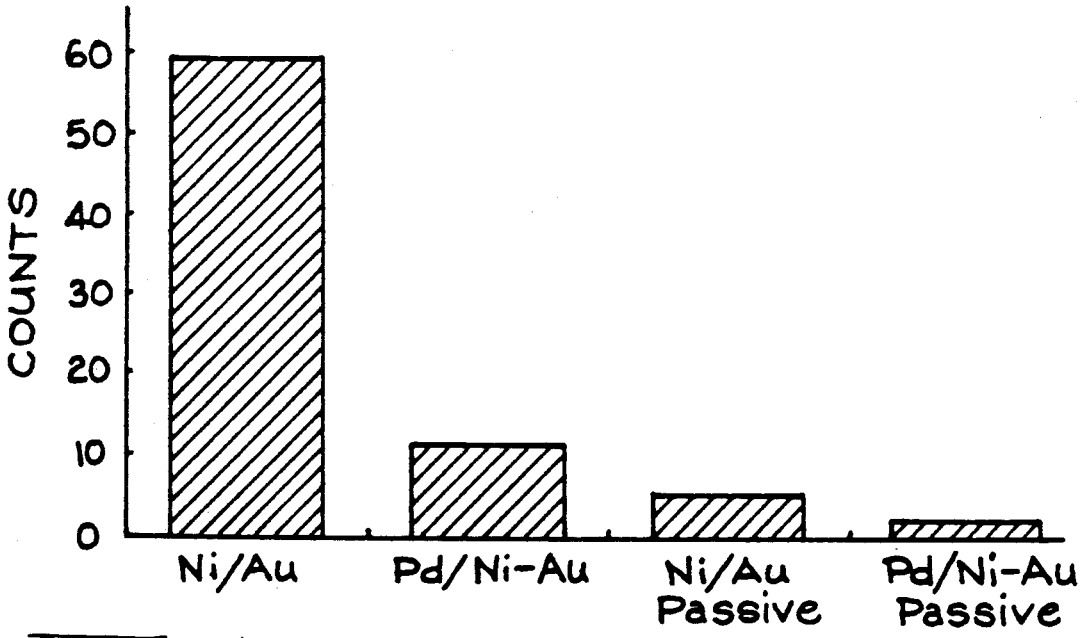
FIG. 1 illustrates the experimental salt-spray-corrosion resistance comparisons and especially illustrates the optimum and unexpected results achieved when passivation is coupled with a Pd/Ni secondary layer.

In accordance with the present invention, it has now been determined that dichromate ions can react with a primary nickel plate layer or secondary nickel-containing plate layer, both through the pores of a final outer precious metal plate, and with nickel present in the final precious metal outer layer, to form a thin dichromate layer over the outer surface layer. This thin layer fills the pores of the surface plated precious metal and coats the surface layer, resulting in greatly increased corrosion inhibition.

The dichromate bath may be prepared from the salt of any alkali metal or amine, but is preferably ammonium dichromate and is prepared by combining a sufficient amount of commercially available ammonium dichromate to an aqueous solution. Typically, a concentration between about 1 g/l and about 10 g/l aqueous ammonium dichromate is prepared. The ammonium dichromate dissociates in aqueous solution in conventional plating tanks by processes well known by those skilled in the electrochemical field. The improved processes of the present invention use conventional plating techniques as are well known in the field.

The bath may be used in either of two ways to create a dichromate layer. First, the dichromate bath is used in conventional electroplating fashion, by running a cathodic current, at a rate of preferably about 31 amperes per square meter to the precious metal plated object being treated and which is suspended completely in the dichromate bath. Second, the precious metal plated object can also be suspended in the dichromate bath in a conventional immersion process for a specified period of time shown to be on the average between from about one to about 20 minutes, and preferably about 1 to about 3 minutes, without supplying any electric charge to the object. With the immersion procedure, the bath is heated to a suitable temperature, generally between from about 20 degrees C. to about 75 degrees C., and preferably from between about 60 degrees C. to about 70 degrees C.

In another preferred embodiment, the process of the present invention is adapted to be used as an electrolytic plating process. A nickel-containing or copper-containing base metal substrate of desired dimension is cleaned and activated in activation tanks by running a charge through the metallic object which is suspended in an activation tank containing commercially available activating agent. The activated base metal is then submerged in a commercially available nickel bath for a sufficient amount of time while supplying a desired amount of amperage, to the system to give a desired primary nickel layer (in micrometers). The process of the present invention is not thought to be used for directly coating copper. Indeed, the dichromate reaction with a primary nickel or nickel-containing metal plate is essential to the the invention's high level of corrosion resistance. In a preferred embodiement the nickel-plated object is next optionally plated with a secondary Pd/Ni plate. After rinsing, either the nickel or the Pd/Ni-plate, the object is similarly submerged in a final precious metal bath, preferably a gold-containing bath which contains disassociated potassium gold cyanide salt in aqueous solution. Known electrolytic methods are used to deposit a final gold-plate layer of desired thickness, and the object is removed from the bath. The gold-plated object is then rinsed in an aqueous tank and then immersed in a ammonium dichromate bath preferablly heated to between about 20 degrees C. to about 75 degrees C. for a suitable duration while suitable amperage is supplied to the metal in the form of a cathodic current, preferably 31 ampere per square meter. The dichromate is electrolytically reacted with the nickel or Pd/Ni underlayers via passivation through the precious metal, preferably gold pores, and the trace nickel known to exist within the final, outer precious metal layer.

In both methods, the dichromate in solution reacts with the primary nickel plate layer or the secondary nickel-containing plate layer immediately beneath the outer precious metal plated layer, through the pores existing in the outer layer. In addition, it has been discovered that the dichromate also reacts with the trace nickel known to exist within the precious metal layer, most preferably the final gold outer layer. This reaction leaves a dichromate layer on the outer surface of the plated metal and in the pores of the outer plated metal layer.

The starting base material substrate employed in the process of the present invention may be any metallic or non-metallic substrate. Preferred are metal substrates which are copper-containing metals or nickel-containing metals. A commercially available nickel-containing plate, preferably a bright nickel plate is plated as the primary plate on the base metal substrate. In one preferred embodiment of the invention, the bright nickel plate is further plated with a palladium/nickel (Pd/Ni) plate as a secondary nickel-containing plate. This layer is then plated with a final precious metal plate. Examples of precious metals include a gold-containing plate, palladium-containing plate, platinum-containing plate, rhodium-containing plate, or ruthenium-containing plate. The gold-containing plate is the preferred final plate.

It should be further noted that the base material or substrate may be non-metallic, so long as it is treated and plated with a metallic plate by methods which are well known in the art. It is contemplated that this plated non-metal must then be further plated with a nickel-containing plate if true passivation is to occur. However, it is believed, that a dichromate layer will form on any exposed metal surface with which the dichromate group can react in solution resulting in an enhancedly corrosion resistant surface.

A preferred embodiment of the invention contemplates the use of any of the aforelisted metals and metallic-type compounds to be used as primary or secondary platings over the aforementioned most preferred base metal substrates. This final precious metal outer plate may be any metallic plate through which a passivation process can occur, preferably gold-containing metals, palladium-containing metals, platinum-containing metals, platinum-containing metals, rhodium-containing metals or ruthenium-containing metals. Most preferably, the final precious metal plate is gold-containing metal plate.

An advantage of the present invention is that the precious metal plated object being treated for enhanced corrosion resistance need not proceed to the dichromate bath within any given time limits after the object has been plated. For example, a nickel or copper base metal substrate which has been primarily coated with a nickel plate is then plated with a final precious metal plate, most preferably gold. According to the process of the present invention, this plated object may sit for days, weeks or even months before it is subjected to the dichromate bath for corrosion resistance treatment. This is a distinct advantage over having to immediately treat the object after the final precious metal plate is applied. Since the dichromate bath need not be kept on the plating line, the instant process reduces the chance of tank contamination from the prior tank. Further, fewer intermediary rinse tanks need be placed on the plating line, saving space usually severely limited in small plating shops. Indeed, since only the one dichromate bath and one rinse tank need be employed to practice the process of the invention, the entire process can be undertaken in an extremely small amount of space.

The ammonium dichromate is particularly desirable for use in the instant passivation invention due to the less aggressive nature of the ammonium cation, should it become entrapped in the gold pores. In addition, the pH value of the dichromate solution is consistent with the pH value of the commercially available acid gold plating process which precedes the dichromate bath.

The figures presented are more fully described in connection with the examples which are provided herein. Further, the following examples are illustrative only and should not be construed as limiting the scope of the present invention.

EXAMPLE

The passivating agent in this experiment was ammonium dichromate ($(NH_4)_2Cr_2O_7$ Mol. wt. = 252.06). All solutions were made up with deionized water (>1 megohm). Samples were prepared for passivation by ultrasonic cleaning in MICRO TM cleaner (International Products Corp., Burlington, N.J.) (2% V/V) and rinsing. After passivation the parts were rinsed in deionized water. The experiment consisted of three treatments described in Table 1.

TABLE 1

Passivation Treatment Schedules

| Treatment ID | Temperature (Degrees C) | Concentration (Gram/Liter) | Time (Min.) | Current (Amp/Front) |
|---|---|---|---|---|
| A | Room Temp | 1.0 (4 mMolar) | 0.5 | 0.5 (80 V) |
| B | 45 C | 10.0 (40 mMolar) | 0.5 | 0.5 (8 V) |
| C (immersion) | 45 C | 10.0 (40 mMolar) | 5 | 0 |

Samples having a surface area of about 25 square centimeters were manufactured from copper alloy 752 and used for evaluation. The samples were then plated with a bright nickel plate followed by a gold plate according to conventional techniques. Samples were then subjected to 48 hour salt fog in accordance with ASTM B-117. All product was evaluated by counting the number of corrosion sites (green or blistered) at 10 X magnification on the entire surface of the samples.

TABLE 2

Initial 48 Hour Salt Spray Testing Results

| Test | L8 Cell Population | Temperature (Degrees C) | Time (min.) | Concentration (grams/liter) | Amperes | Avg. Counts Untreated | Avg. Counts Passivated |
|---|---|---|---|---|---|---|---|
| 1 | 3 | Room Temp. | 0.5 | 1 | 0.5 | 118.8 | 2.6 |
| 2 | 3 | Room Temp. | 0.5 | 1 | 0.5 | 102.8 | 3.6 |
| 3 | 3 | 45 | 0.5 | 10 | 0.5 | 38.8 | 1.4 |
| 4 | 5 | Room Temp. | 0.5 | 1 | 0.5 | 70.8 | 0.8 |
| 5 | 5 | 45 | 0.5 | 10 | 0.5 | 70.8 | 0.4 |
| 6 | 3 | 45 | 5.0 | 10 | Immersion | 118.8 | 4.0 |

Figure 2:
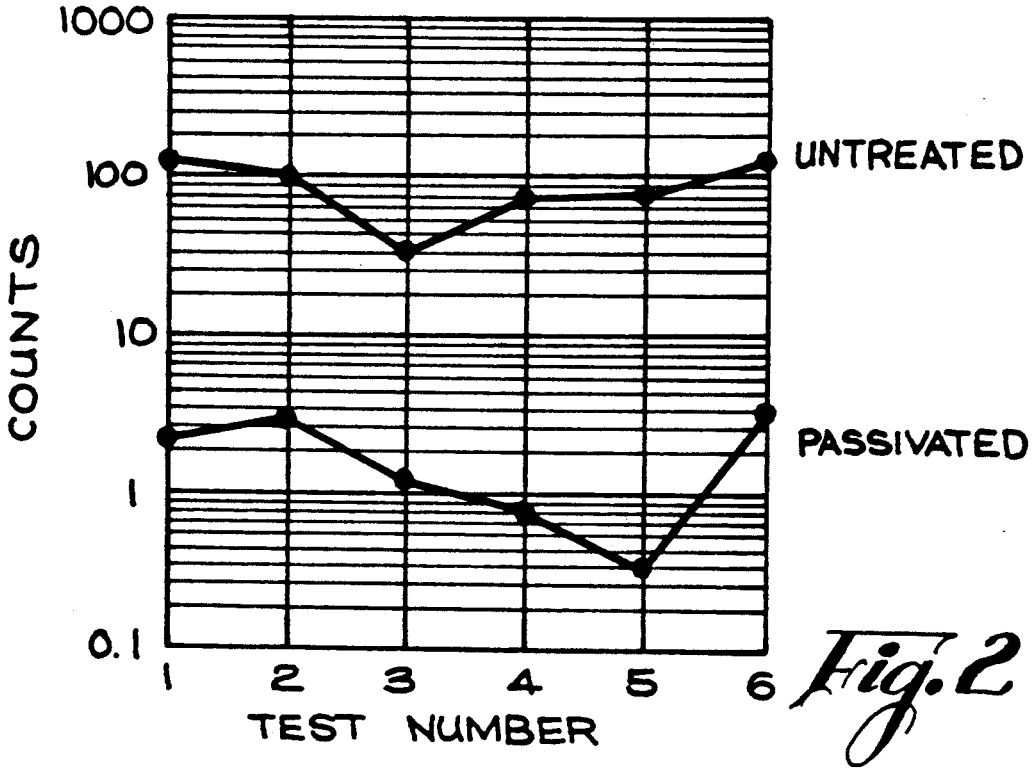
FIG. 2 illustrates the results of the passivation experiments in relation to salt spray performance.

The samples were produced on the automatic gold plating line two months earlier. Such sample treatments are shown in Table 2. The column labelled $L_8$ Cell refers to the identity of the sample population referenced to the inventor's earlier study of salt spray performance. The improvement in performance is readily apparent in the comparison of counts untreated vs. counts passivated. FIG. 2 graphically illustrates the improvements as a result of the passivation treatments. The y-axis count data is presented on a logarithmic scale for clarity.

CONCLUSIONS

The post-passivation treatment is more significant in salt spray (fog) corrosion than the Pd/Ni alone or other plating process parameters tested. Pd/Ni barrier layers used in concert with passivation will dramatically improve corrosion resistance to unexpected levels. The combination of Pd/Ni barrier and passivation treatment will reduced the number of salt spray corrosion sites per front to essentially zero. (See FIG. 1).

While the invention has now been described with respect to certain preferred embodiments thereof, and illustrated in terms of various examples, it will be appreciated by the skilled artisan that various omissions, modifications, substitutions, and other changes may be made without departing from the spirit thereof. Accordingly, it is intended that the invention be limited only by the scope of the following claims.

What is claimed is:

1. A method for reducing the corrosion of precious metal plated objects, the improvement comprising
   electroplating an object with a primary nickel-containing plate,
   electroplating the primary nickel-containing plate with the secondary nickel-palladium plate,
   electroplating the secondary nickel-palladium plate with a precious metal plate, and
   immersing the precious metal plated object in an aqueous solution containing about 1 gm/l to about 10 gm/l of ammonium dichromate at temperatures from about 20° C. to about 50° C. for a period of about 1 minutes to about 20 minutes.

2. The method of claim 1 wherein the precious metal plated object is immersed in the solution from between about 1 minute and about 3 minutes.

3. The method of claim 1 wherein the precious metal plate is selected from the group consisting of gold-containing plate, platinum-containing plate, palladium-containing plate, rhodium-containing plate, and ruthenium-containing plate.

4. The method of claim 3 wherein the precious metal plate is gold-containing plate.

5. The method of claim 1 wherein the precious metal plated object is an eyewear frame.

6. A precious metal plated object wherein the object is treated by the process according to claim 1.

7. An eyewear frame prepared by the method of claim 1.

* * * * *